US009783908B2

(12) United States Patent
Kondo

(10) Patent No.: US 9,783,908 B2
(45) Date of Patent: Oct. 10, 2017

(54) PLATING BATH METROLOGY

(71) Applicant: MOSES LAKE INDUSTRIES, INC., Moses Lake, WA (US)

(72) Inventor: Muneharu Kondo, Vancouver, WA (US)

(73) Assignee: Moses Lake Industries, Inc., Moses Lake, WA (US)

( * ) Notice: Subject to any disclaimer, the term of this patent is extended or adjusted under 35 U.S.C. 154(b) by 270 days.

(21) Appl. No.: 14/437,351

(22) PCT Filed: Oct. 22, 2013

(86) PCT No.: PCT/US2013/066059

§ 371 (c)(1),
(2) Date: Apr. 21, 2015

(87) PCT Pub. No.: WO2014/066313

PCT Pub. Date: May 1, 2014

(65) Prior Publication Data

US 2015/0284871 A1 Oct. 8, 2015

Related U.S. Application Data

(60) Provisional application No. 61/717,225, filed on Oct. 23, 2012.

(51) Int. Cl.
*C25D 21/12* (2006.01)
*C25D 21/14* (2006.01)
(Continued)

(52) U.S. Cl.
CPC ..... *C25D 21/14* (2013.01); *C25D 3/38* (2013.01); *C25D 7/12* (2013.01); *C25D 17/001* (2013.01); *C25D 21/12* (2013.01)

(58) Field of Classification Search
CPC ..... C25D 7/12; C25D 17/001; C25D 21/14; C25D 21/12
See application file for complete search history.

(56) References Cited

U.S. PATENT DOCUMENTS 4,132,605 A 1/1979 Tench et al.
4,666,567 A 5/1987 Loch
(Continued)

FOREIGN PATENT DOCUMENTS

KR 1020060074593 A 7/2006
KR 1020120061754 A 6/2012

OTHER PUBLICATIONS

International Search Report, PCT/US2013/066059, dated Feb. 24, 2014 (3 sheets).
(Continued)

*Primary Examiner* — Brian W Cohen
(74) *Attorney, Agent, or Firm* — Reza Mollaaghababa; Thomas Engellenner; Pepper Hamilton LLP

(57) ABSTRACT

Techniques for performing bath metrology on electroplating mixtures are disclosed. In particular, the disclosed techniques can be used in conjection with traditional metrology methods such as cyclic voltammatric stripping (CVS), and are capable of detecting changes in bath components at a more sensitive level than CVS in some circumstances. In some instances, deviations in observed current values from potentiostatic methods vis-à-vis a calibration standard can provide indications of changes in the mixture, and provide an indicator when a depleted component has been sufficiently added to restore the mixture to a previous state.

32 Claims, 5 Drawing Sheets

(51) Int. Cl.

| | |
|---|---|
| ***C25D 3/38*** | (2006.01) |
| ***C25D 7/12*** | (2006.01) |
| ***C25D 17/00*** | (2006.01) |

(56) References Cited

U.S. PATENT DOCUMENTS

| | | | |
|---|---|---|---|
| 4,917,777 | A | 4/1990 | Fisher |
| 5,192,403 | A | 3/1993 | Chang et al. |
| 5,223,118 | A | 6/1993 | Sonnenberg et al. |
| 5,298,129 | A | 3/1994 | Eliash |
| 5,298,130 | A | 3/1994 | Ludwig |
| 5,298,131 | A | 3/1994 | Eliash et al. |
| 5,972,192 | A | 10/1999 | Dubin et al. |
| 6,365,033 | B1 | 4/2002 | Graham et al. |
| 6,551,479 | B1 | 4/2003 | Graham et al. |
| 6,572,753 | B2 | 6/2003 | Chalyt et al. |
| 6,643,226 | B1 | 11/2003 | Thayer et al. |
| 6,709,561 | B1 | 3/2004 | Pavlov et al. |
| 6,733,656 | B2 | 5/2004 | Chalyt et al. |
| 6,749,739 | B2 | 6/2004 | Chalyt et al. |
| RE38,931 | E | 1/2006 | Graham et al. |
| 7,124,120 | B2 | 10/2006 | Wikiel et al. |
| 7,186,326 | B2 | 3/2007 | Shalyt et al. |
| 7,229,543 | B2 | 6/2007 | Graham et al. |
| 7,270,733 | B2 | 9/2007 | Wikiel et al. |
| 7,291,253 | B2 | 11/2007 | Pavlov et al. |
| 7,879,222 | B2 | 2/2011 | Shalyt et al. |
| 8,535,504 | B2 | 9/2013 | Pavlov et al. |
| 2004/0000484 | A1 | 1/2004 | Sun et al. |
| 2006/0151327 | A1 | 7/2006 | Sonnenberg et al. |
| 2011/0025338 | A1 | 2/2011 | Willey et al. |
| 2013/0161203 | A1* | 6/2013 | Mayer ..... C25D 21/14 205/775 |

OTHER PUBLICATIONS

Written Opinion of the International Search Authority, PCT/US2013/066059, dated Feb. 24, 2014 (4 sheets).

Okubo, T., et al., "Electrochemical Monitoring Method for Filling Capability of Copper Electroplating Solution for Via Filling," Japan Institute of Electronics Packaging, 8(4):318-324 (2005).

Tench, D., et al., "Cyclic Pulse Voltammetric Stripping Analysis of Acid Copper Plating Baths," J. Electrochem Soc.: Electrochemical Science and Technology, Apr. 1985, pp. 831-834.

* cited by examiner

PLATING BATH METROLOGY

CROSS REFERENCE AND RELATED APPLICATIONS

The present application is a National Stage filing under 35 U.S.C. §371 of PCT/US2013/066059, filed on Oct. 22, 2013, entitled "Improvements in Plating Bath Metrology," which claims priority to U.S. Provisional Patent Application bearing Ser. No. 61/717,225, entitled "Improvements in Bath Metrology," filed Oct. 23, 2012; the entire contents of which are hereby incorporated by reference herein.

FIELD OF THE APPLICATION

The technical field of the present application is directed generally to metallic plating of substrates, such as substrates used in semiconductor packaging, wafers, and other electronics' related industries.

BACKGROUND

The growth of the electronics industry has been premised on the industry's ability to create devices that can process more and more instructions, faster and faster, while continuing to shrink the size of such devices. Advances in processes to enable this growth include not only manufacturing processes that allow the creation of smaller and smaller scale features on semiconductor substrates, but auxiliary processes that support such manufacturing steps.

For instance, processes that utilize a metallic plating bath to plate metal onto substrates require supporting methods to keep the plating bath at a particular condition (e.g., concentration level of various components) to ensure plating performance. Accordingly, plating bath metrology is an important capability, and improvements in such are desired generally to help maintain today's semiconductor manufacturing processes, as well as new processes that are being created.

SUMMARY

Some embodiments of the present application are directed to methods for performing plating bath metrology. Electro-metallic plating on a semiconductor substrate using a metallic plating mixture can be performed. A fixed voltage can be applied between a test cathode and a test anode in the plating mixture, which can cause metal plating on the test cathode. One or more current values can be associated with the fixed voltage and be measured, for example over a designated period of time where the current value(s) can optionally vary of the period, and the current value(s) can be compared with a calibration value(s). The deviation between the current value(s) and the calibration value(s) can be correlated with a change in a polarization measure of the metallic plating mixture, which can optionally correspond with deterioration of at least one component in the metallic plating mixture. The deviation can be used to control a concentration of one or more organic additive components (e.g., a suppressor component). In some embodiments, a quantity of one or more components of the metallic plating mixture can be added, e.g., after the correlating step based on the deviation between the at least one current value and the calibration value. For instance, the addition can be used to decrease the deviation between a current value and a calibration value.

A variety of other embodiments can also be practiced in the present application. In some instances, the metallic plating mixture can be a copper metal plating mixture and/or can contain a plurality of organic additive components and/or no more than two organic additive components. In another instance, the applying step and measuring step can be performed in a separate container, and/or isolated container, having a portion of the metallic plating mixture that is extracted from the container where metallic plating is occurring. Alternatively, the test anode and the test cathode can be located in the bath where substrate plating is occurring, the test electrodes being optionally isolated in a manner to substantially not affect electro-metallic plating on the semiconductor substrate.

In other embodiments, cyclic voltammetric stripping can be performed in conjunction, which can aid control of one or more additional organic components in the metallic plating mixture (e.g., an accelerator component). In another embodiment, one or more current values can be characterized as an integrated current value over a period of time (e.g., a total charge value), and/or a plurality of current values can be measured. As well, polarization measures can comprise any of a concentration of one or more components in a metallic plating mixture, a measure of electro-metallic plating performance, and a deterioration of at least one component in the metallic plating mixture.

Calibration values can include a calibration current value that is measured in a test mixture, which can be subjected to a fixed voltage like the metallic plating mixture. Furthermore, the test mixture can contain a component that is also present in the metallic plating mixture, where the test mixture can exhibit less deterioration of the component than the metallic plating mixture. In some embodiments a calibration curve can be formed that includes two or more calibration measurements that can each correspond to a particular metallic plating mixture exhibiting a particular polarization measure. Accordingly, one or more current values can be compared with a value from such a calibration curve.

BRIEF DESCRIPTION OF THE DRAWINGS

Aspects of the present invention will be more fully understood from the following detailed description taken in conjunction with the accompanying drawings (not necessarily drawn to scale), in which.

DETAILED DESCRIPTION

Definitions

Figure 1A:
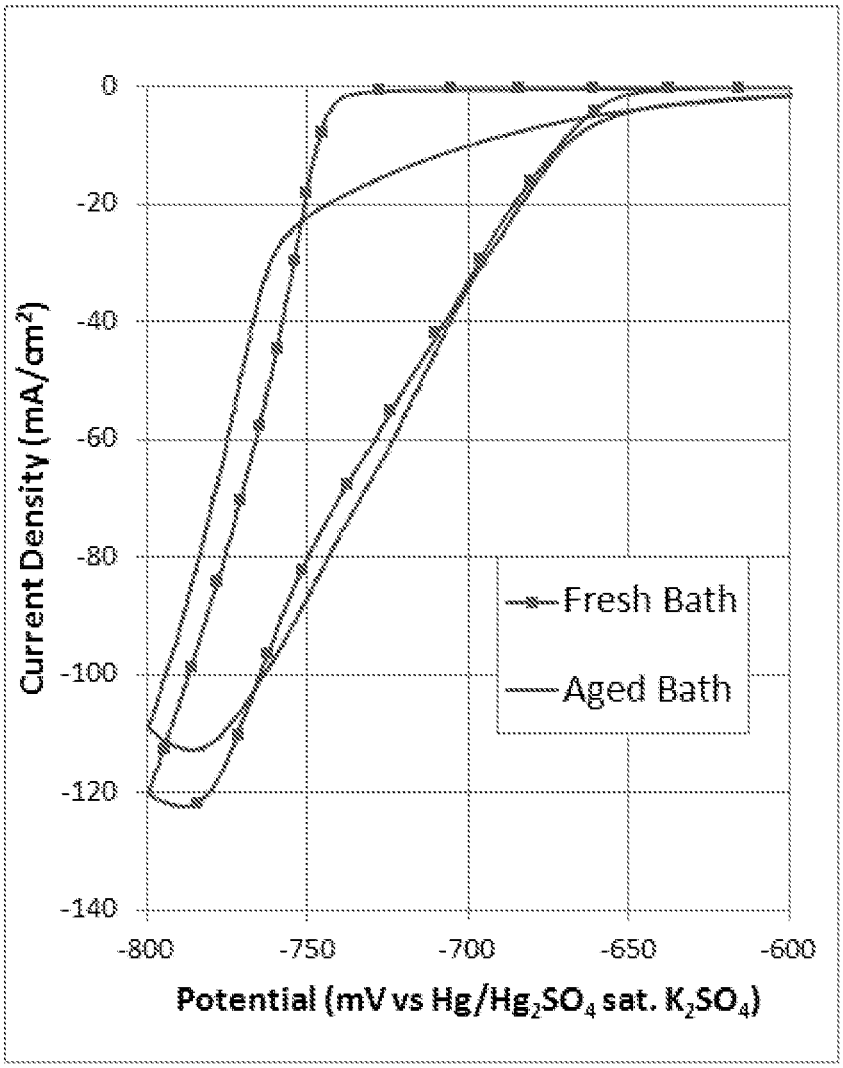
FIG. 1A contains linear sweep voltammetry graphs of measured current density in milliamperes per square centimeter as a function of applied potential in millivolts relative to saturated calomel electrode for a fresh metallic plating mixture and an aged metallic plating mixture consistent with some embodiments of the present application.

Unless the context or by explicit mention the description dictates otherwise, the following terms have the following definitions as utilized throughout the present application.

As utilized herein, the term "copper metal" refers to a metallic material that comprises at least 30% copper by weight. Accordingly, a copper metal can include a number of other constituents beyond copper atoms.

As utilized herein, the terms "electro-metallic plating" and "electroplating" can be used interchangeably, and refer to the processes for depositing metal onto an electrode surface by an electrochemical oxidation/reduction reaction. Non-limiting examples of electroplating that can be utilized by the embodiments of the present application include any of electrolytic plating, electroless plating, and other types of metal plating and/or stripping processes that utilize chemical oxidation/reduction reactions. Such processes can be driven spontaneously, and/or can be induced by the application of various types of electrical potentials or currents.

As utilized herein the phrase "metallic plating mixture" refers to a chemical formulation containing metal ions that can be used to cause electroplating of the metal ions on an electrode surface, and/or the dissolution of metal ions from an electrode into the metallic plating mixture. In the present application, it is understood that any disclosure associated with the term metallic plating mixture is also associated with any particular metal plating mixture such as a copper metal plating mixture and vise versa. So an embodiment that includes a metallic plating mixture also applies to an embodiment with any particular metal plating mixture and vise versa, unless specifically disclaimed in the specification.

As utilized herein the phrase "fresh metallic plating mixture" refers to a metallic plating mixture that exhibits an electrochemical response to an electrochemical stimulus that is substantially the same as a metallic plating mixture without the presence of breakdown products, other by-products, or changes in concentration of any components of the mixture as first prepared. For instance, when a fresh metallic plating mixture is exposed to electrodes with a set voltage drop, the fresh mixture's electrochemical response (e.g., current, charge over time, polarization) is within 5%, 4%, 3%, 2%, 1%, 0.5%, 0.1%, or 0.05% of the response of a metallic plating mixture subject to the same conditions that has just been prepared and not been previously subjected to any electrochemical stimulation.

As utilized herein, the term "polarization measure" refers to a value of some quantity or a quality that is associated with polarization. A polarization measure can be represented in various ways, and typically correlates with polarization in some manner. For example, the polarization measure can be the polarization as measured in a standard electrochemical methodology known to those skilled in the art. In another example, when the polarization correlates with the concentration of one or more components in a metallic plating mixture, the polarization measure can be the concentration of the correlating component(s). In yet another example, when the polarization correlates with the plating performance of a metallic plating bath, the polarization measure can be the performance of bath under certain conditions. Performance can be the number, or tendency, to form particular defects and/or the speed of metal plating and/or surface finish of the metal plated, as well as other measures including those known to one skilled in the art. Further examples can include a measured current or current density, integrated current or charge, and other measures of electrochemical response including those known to one skilled in the art.

As utilized herein, the terms "substrate" and "semiconductor substrate" can be used interchangeably, and refer to substrates that are used in the making of semiconductors, integrated circuits, microelectromechanical systems, and other similar type microelectronic devices. Non-limiting examples of substrates including wafers, printed circuit boards, and other fixtures used to form semiconductors and other miniaturized circuit features. Substrates can also include featured substrates, which are substrates that have features that are smaller than 100 microns and/or nanometers in size (e.g. a trench or via width, height, and/or depth). Such featured substrates are often important in advanced electronics manufacturing as the filling of such features with metal, such as copper metal, is used to form chip interconnects and/or other device features. Accordingly, embodiments of the present application can be directed to various types of electroplating types such as damascene, through-silicon-via, bump formation, and other kinds of wafer or substrate based packaging applications.

Description of Some Embodiments

Embodiments of the present invention can be directed to methods for detecting changes in a metallic plating mixture (e.g., a copper metal plating mixture) that can be utilized to conduct electroplating of the metal ions in a plating bath on a substrate, such as the surface of a semiconductor substrate (e.g., a wafer surface, circuit board, or other substrate). The embodiments can also include processes that allow one to adjust the conditions in the metallic plating bath, which can alleviate the detected changes and potentially help enhance metal plating performance on the substrates. For instance, the concentration of one or more components in the metallic plating mixture can be controlled by adding a quantity of the component(s) based on the detected change, the concentration of the mixture being set when the detected change has been decreased below a set value.

Electro-metallic plating of substrates is often conducted in various processes (e.g., batch or continuous) in which a series of substrates to be plated are exposed to a metallic plating mixture or plating bath. For example, a current or voltage is applied between an electrode and the surface of the substrate in the presence of an aqueous sulfuric-acid copper metal plating solution to induce copper metal deposition on the substrate surface. The conditions of a metallic plating mixture are often carefully monitored because changes in component concentrations can affect various plating performance metrics such as plating speed and defect creation. Accordingly, the components of the mixture may need to be replenished with time, either through a bleed and feed process, a total mixture replacement, and/or occasional infusion of the mixture by one or more particular components.

Plating bath metrology techniques have been employed to ascertain the concentration of various chemical components of a metallic plating mixture. For instance, metal plating mixtures can utilize one or more organic additives (e.g., accelerators, levelers, and suppressors) to help enhance metallic growth and/or decrease the formation of defects in deposited metal, especially when plating recessed trenches and vias of semiconductor substrates. Since the total concentration of these organic additives is typically a very small percentage of the mass of the plating mixture (e.g., less than 2%, 1%, or 0.5% of the plating mixture by mass or volume), changes in their concentrations can have a profound effect on metal plating performance.

Current bath metrology techniques include cyclic voltammetric stripping ("CVS"), which can be used to monitor the concentration of particular organic additives in a metal plating bath. In general, CVS involves the repeated sweeping of an applied voltage through a predetermined cycle with time, which results in the plating of metal on a cathodic surface and the subsequent stripping of the metal when the voltage is reversed. During the stripping phase, the integrated current is measured and compared with the integrated current of a bath having a known quality (e.g., concentration of one or more components). The prior art, in general, discourages current measurement during the plating phase, indicating that such is less precise because of reduction reactions that can occur in the bath during the cathodic portion of the voltammetric cycle.

Cyclic pulsed voltammetric stripping ("CPVS") is a modified version of CVS in which repeated sequential pulsing between appropriate metal plating, metal stripping, cleaning, and equilibrium (i.e., open circuit condition) potentials is applied to maintain the electrode surfaces in a clean and reproducible state. CPVS correlates the amount of an organic component in the bath (e.g., the accelerator or brightener) by measuring the total charge used during the metal stripping phases of the cycle, and comparing those measured charges against the measured charges of a similar bath having a known concentration of the organic component.

It has been observed, however, that CVS techniques have failed to detect changes in the polarization of a metal plating bath as well as the changes in metal plating performance of the bath on a cathodic surface. Without being bound by any particular theory, it is conjectured that the deterioration of particular organic additives in a metal plating bath, for example through the build-up of by-products or the loss of the concentration of the organic additives, that has been operating over a period of time may be responsible for a change in polarization of the bath. It has been observed that while a CVS technique indicated that an organic additive was at a particular concentration level, the bath performance exhibited deteriorated plating performance, and the addition of more of the organic additive was needed to recover the original metal plating performance. Accordingly, another metrology technique was needed to help identify changes in this particular organic component.

Some embodiments of the present application are directed to techniques that can monitor changes in metallic plating mixtures over time and, in particular can detect the change in polarization of the mixture, which can result from the chemical breakdown of one or more organic additives (e.g., exhibited by the build-up of by-products of the broken down chemical and/or the decrease in concentration of one or more components in the bath). In some embodiments, one or more test electrodes (e.g., a test cathode and/or a test anode) can be inserted into a metallic plating mixture (e.g., a copper metal plating mixture) in which the mixture can be actively used to electro-metallically plate substrates. In some instances, a voltage has been applied between the test electrodes, which can induce a flow of current between the electrodes to cause metallic plating (e.g., copper metal plating) on the cathode. Alternatively, a spontaneous current can flow if the electrode potentials are suitable. The current can be measured in terms of some type of current value, and can be compared to a calibration value. The calibration value can be the current value associated with a metallic plating bath in a particular condition, e.g., a fresh metallic plating bath or a metallic plating bath subjected to a predetermined electrical activation such as charge or applied voltage over a designated period of time. A detected deviation between the current value and the calibration value can be correlated with a measure of polarization change, which can be related to the chemical breakdown of one or more organic components in the metallic plating mixture. A quantity of the one or more organic components can be added to the mixture based upon the detected deviation to adjust the concentration of the one or more organic components in the mixture. In some embodiments, the addition of one or more organic components can be used to decrease the deviation between the current value and the calibration value, which can indicate restoration of the correct concentration of the one or more organic components, the targeted polarization measure of the metallic plating mixture, and/or the desired plating performance of the metallic plating mixture.

Techniques consistent with embodiments described in the present application can provide advantages over prior art techniques. As described herein, for example, CVS methods have been found to be inadequate in controlling the performance of metallic plating baths. Without being bound to any particular theory, it is believed that CVS techniques may mask the changes in a polarization measure that can be indicative of chemical breakdown in a metallic plating bath at a particular applied voltage because CVS provides an integrated measure of the current associated with stripping plated metal over a scanned range of voltages. FIG. 1A depicts typical linear sweep voltammetry graphs of a fresh copper metal plating mixture and an aged copper metal plating mixture over a region of applied potentials where metal is plated on the working electrode. The particular values of the measured current density at a particular applied voltage relative, to a saturated calomel electrode, for the fresh and aged mixtures can vary widely. However, the integrated current over a scanned region of voltage may not necessarily reflect a noticeable in the mixtures.

Accordingly, embodiments of the present application can include applying a fixed voltage between a cathode and anode (e.g., including the use of one or more test electrodes) to measure a resulting current value, where the fixed voltage can be chosen to indicate a change in a polarization measure between a fresh metallic plating mixture and one that exhibits chemical breakdown, which can affect metal plating performance. In some instances, the fixed voltage to be applied between one or more test electrodes can be chosen to magnify a deviation between a current value of a metallic plating mixture to be monitored and a calibration value of a known calibration sample, where the deviation is indicative of the difference in chemical breakdown of the one or more organic additives in the monitored mixture relative to calibration sample.

Figure 1B:
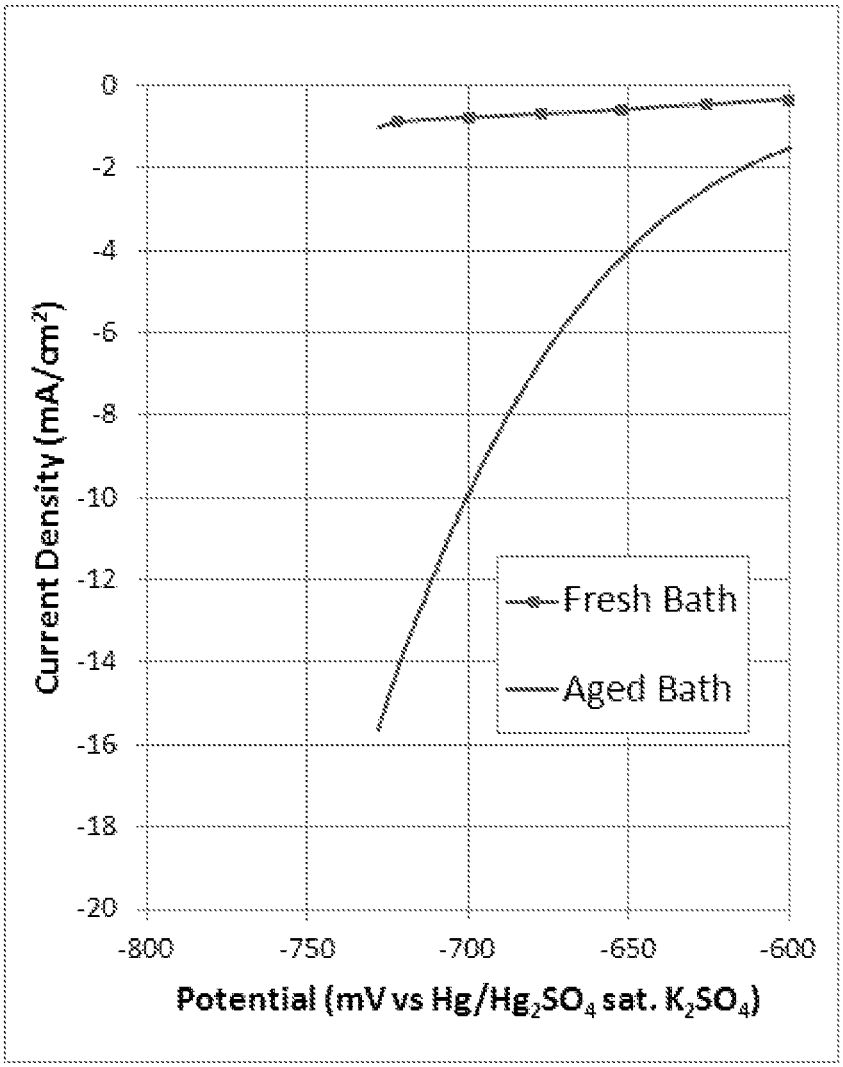
FIG. 1B depicts an expanded portion of the linear sweep voltammetry graphs of FIG. 1A.

Identification of the fixed voltage to be used with embodiments of the present application is within the knowledge of one of ordinary skill in the art in some instances, and can be performed using a variety of techniques such as making appropriate scanning measurements using linear sweep voltammetry. For example, FIG. 1B provides an expanded view of the linear sweep voltammetry graphs shown in FIG. 1A, depicting only one direction of the sweep. When the applied potential is small, the differences in current density between the fresh and aged mixtures are smaller and more difficult to ascertain. At high negative applied potentials, however, metal plating can exhibit undesirable nodule formation on the plating surface. Accordingly, one can utilize the plot in FIG. 1B to choose an applied potential that exhibits a noticeable difference in polarization measure (e.g., difference in current density) between a fresh mixture and an aged mixture while still operating in a desirable plating regime that avoids poor plating performance such as nodule formation.

Another potential distinction between embodiments of the present application and CVS or CPVS techniques is that the methods of the present application need not be repeated in a cyclic manner as typically practiced with CVS, though they may be in some embodiments.

A further potential distinction is that prior art methods perform their analytical detection during stripping phase of the working electrode after the electrode has undergone a plating phase. As indicated earlier, CVS and CPVS techniques plate metal upon the working electrode, followed by stripping of the metal-plated working electrode. The current is measured and integrated during the stripping phase because of the prior art's suggestion that current measurements during the plating phase suffer from reduction reactions that can skew the measured current. As well, the prior art suggests that integration during the stripping phase gives a magnified signal because of the much smaller differences in integration values associated with the plating phase.

In contrast, embodiments of the present application measure a current value associated with a fixed voltage applied between a cathode and anode where the applied potential results in plating on the comparable working cathode relative to CVS techniques, i.e., the applied potential is in a range consistent with the metallic plating of a substrate by the mixture. As shown by the examples herein, use of current values associated with plating of the working electrode can result in improved measures of metallic plating performance relative to stripping-based metrologies (e.g., CVS). While not being limited to any particular theory, it is believed that stripping-based metrologies are less accurate than the present application's plating-based metrology embodiments at least because the stripping action will result in dissolution not only of the metal plated during the earlier portion of the cycle but also the underlying metal that may have been previously seeded to enable metal plating on the working electrode. Therefore, the current value associated with stripping may include contributions for metal that is plated by another mechanism, potentially resulting in a skewed current value measurement. In some embodiments, the applied voltage to plate metal on a working electrode is preceded by an earlier plating voltage application to provide an initial layer of the metal and to isolate any initial effects of plating on a different seeded surface.

In some embodiments, the methods can be practiced in situ, i.e., the test electrodes are placed in the same bath container in which metallic plating of the substrate is taking place. In such situations, it can be advantageous to isolate the test electrodes in a manner such that the metallic plating on a substrate that is taking place simultaneously is substantially not affected by (or affecting) the electrical activity of the test electrodes. Such isolation techniques include those well understood by those skilled in the art. As an example of an isolation technique, in some instances a membrane can be used to isolate an electrode from products that would adversely affect its performance. In some embodiments, the methods can be practiced in a separate container from where metallic plating is performed. For instance, a portion of the metallic plating mixture can be extracted from the plating bath and can be placed in a separate container where the test electrodes are exposed to the extracted sample.

The one or more test electrodes are typically distinct from the cathode (e.g., cathodic surface that is being metal plated) and anode that are used to perform the metallic plating of the substrate. The types of test electrodes can vary. In some instances the use of a rotating disk electrode can be advantageous (e.g., a rotating disk cathode). In some embodiments, the anode and/or cathode can include platinum metal.

In some embodiments, a deviation between a measured current value and a calibration value can be indicative of a change in polarization measure, which can be exemplified by, for example, chemical breakdown of one of more components in the metallic plating mixture. The measured current value can be formulated in many different ways. For instance the current value can be the actual measured current using a test electrode at some particular moment in time. In other instances, the current value can be a value associated with a plurality of current measurements taken over a period of time. For example, the current value can be a quantity associated with the integration of current values over a period of time (e.g., a value associated with total charge, for example, that flows over the period of time, which can optionally be obtained by methods such as used in pulse CVS). Such a quantity may provide a more sensitive measure of deviation since a number of deviation measurements are summed together. In some embodiments, the period of time can be chosen so that enough charge is collected to provide a signal without large variation when repeated (e.g., the total charge collected exceeds a designated threshold value such as 10 millicoulombs). Variations of these current value embodiments are all within the scope of the present application, including variations known to those skilled in the art.

In some embodiments, the measured current value, or a component of the value when the value is, for instance, integrated in time, can substantially vary over the period of time in which the value is measured, i.e., at least one current value measured during the period of time can vary from another current value measured during the period of time by more than about 3%, 4%, 5%, 6%, 7%, 8%, 9%, 10%, 15%, 20%, 25%, 30% or any limit value higher, lower, or interstitial to the stated values. Such embodiments are distinct from prior art teachings in which a measured current or current density (or associated integrated value) is only utilized after the value reaches a steady-state value. As shown in the examples herein, in many instances the current value can vary substantially over the period of time in which it is measured without adversely affecting the results associated with using such current values. In some embodiments, the period of measurement begins immediately following a step change in applied voltage. In such instances, any transient associated with the change in applied voltage can be incorporated into the current value, in contrast with the prior art.

The calibration value can be obtained by any appropriate technique consistent with the practices in the present application. In many instances, the calibration value is a measured current value when the fixed voltage is applied between test electrodes of a test mixture. The measured current value can be associated with the concentration of one or more components of the metallic plating mixture but does not have to be associated as such. Many types of test mixtures can be used in such contexts. In some embodiments, the test mixture can be a fresh metallic plating mixture. In other embodiments, the test mixture can be a mixture that is not identical to the metallic plating mixture used to plate a substrate, but can contain the organic components whose deterioration is to be detected in some other type of suitable medium.

In other embodiments, the calibration value can be some value that differs from a measured current value as previously discussed, but can utilize that value. For instance, the calibration value can be some elevated value relative to a measure current value, to help insure a sufficient level of one or more components in the bath.

As well, it can be advantageous for the calibration value to be established using a protocol similar to what will be used to establish corresponding current values for comparison (e.g., using a single current measurement of the calibration sample, or a plurality of integrated measurements as are used when determining the current value(s) of a used metallic plating mixture).

In other embodiments, a calibration curve can be utilized, which can include one or more calibration values. A calibration curve can include a plurality of calibration measurements performed on different metallic plating mixtures. For instance, each measurement can correspond to a current value associated with a particular metallic plating mixture that has been subjected to a predetermined electrical stimulus (e.g., a fixed voltage drop for a designated period of time or total amount of charge passed through the mixture). As an example, a plurality of fresh metallic plating mixtures can each be subjected to different electrical stimulus measures, with a corresponding current value being measured in each mixture. These measurements can be plotted as a function of the electrical measurements to provide the calibration curve. Accordingly, when a metallic plating mixture's current value is measured, the measured current value can be compared with a corresponding interpolated or actual value on the calibration curve. Measured current values can be any of the embodiments previously described herein. In some embodiments, the current value can be integrated current or total charge (e.g., total charge/volume of metallic plating mixture).

It is understood that the phrase "calibration curve" can refer to some mathematical representation of measured electrical response values with respect to electrical stimulus measures. So while the term "curve" typically suggests a pictorial representation, herein "calibration curve" can also refer to other mathematical or heuristic representations of the plurality of calibration measurements that would allow one to interpolate data between the measures, or extrapolate the data, including in manner consistent with knowledge of those skilled in the art. Accordingly, a "calibration curve" can be embodied as a mathematical model, a table of values, or any other representation consistent with the understanding of those skilled in the art.

The step of comparing one or more current values with a calibration value can be performed in any number of manners including those known to one skilled in the art. In some embodiments, the step of comparing one or more current values with a calibration value can be formulated using a value known as the Bottom Up Index. For a given metallic plating mixture to be monitored, the fixed voltage to be applied between electrodes can be determined, e.g., by examining appropriate linear sweep voltammetry curves as previously described, along with a period of time over which the fixed voltage can be applied. Based on these parameters, a total charge $Q_{Fresh\ Mixture}$, can be measured by preparing a fresh metallic plating mixture and applying the fixed voltage across the electrodes to cause metallic plating on the cathode for a given period of time. Accordingly, the value of $Q_{Fresh\ Mixture}$ can act as the calibration value. Next, the total charge of a sample of the mixture to be examined, $Q_{sample}$, can be measured by applying the fixed voltage to the sample of the mixture over the given period of time. Since the aged baths tend to alter the current flow through the bath relative to a fresh bath, one measure of the change in charge passed by an aged bath is given by the equation:

$$\text{Bottom Up Index}=100\times Q_{Fresh\ Mixture}/Q_{sample}$$

Accordingly, the closer that the Bottom Up Index is to the value 100, the smaller the deviation between $Q_{Fresh\ Mixture}$ and $Q_{sample}$, and the more the sample passes charge like a fresh metallic plating mixture at the fixed voltage for the given period of time.

By comparing one or more measured current values with a calibration value, one can derive a deviation that can be correlated with a change in polarization measure between the measured metallic plating mixture and a calibration mixture measured to derive the calibration value. In some embodiments, when the change in polarization measure is related to a change in the state of the metallic plating mixture, the correlated deviation can be related the change in state of the mixture. For instance, the polarization measure can be related to a change in the actual polarization, a concentration of one or more components in the metallic plating mixture (e.g., the concentration of an organic additive component or the concentration of a breakdown byproduct), the temperature of the mixture, and/or the plating performance of the mixture. Accordingly, in some embodiments, the deviation can be directly related to any of these changes in state of the metallic plating mixture without explicit reference to the polarization.

As one example, a metallic plating mixture can be subjected to aging by exposure to charging through electrodes that are subject to a fixed voltage or current flow for a chosen period of time. At various times during the charging, samples of the mixture are taken and the Bottom Up Index is determined for each. As well, corresponding measurements of concentrations and/or metallic plating performance (e.g., each sample is used to metallically fill features on a semiconductor substrate) can be conducted with the samples. Accordingly, when a subsequent metallic plating mixture's Bottom Up Index is determined, the mixture's component concentration and/or fill performance can be estimated by comparison with the Bottom Up Indices found during the charging experiment.

Using the techniques described herein, embodiments can control one or more concentrations of components in a metallic plating bath. Such control can be affected using the deviation between a measured current value and the calibration value, e.g., through addition of the one or more components into the plating mixture, which can potentially decrease the deviation between a subsequently measured current value of the mixture after addition and the calibration value. As an non-limiting example, the previously discussed charging experiment may determine that a Bottom Up Index below a critical value correlates with poor metallic fill performance in the features of a semiconductor substrate. Accordingly, the concentration of one or more components of the mixture, which can be subject to chemical breakdown, may be increased by adding the component(s) until the Bottom Up Index of the augmented mixture reaches or exceeds the critical value.

While the techniques of the present application can be used to control any component of a metallic plating mixture that affects a polarization measure of the mixture, some embodiments are used to control one or more organic additive components in the mixture. As previously indicated, organic additives, such as accelerators, levelers, and suppressors, among others, can heavily influence the metallic plating performance of a mixture into the features of a semiconductor substrate though each constitutes a small fraction of the total mass of the mixture. Suppressors, also sometimes known as a surfactant, can generally decrease the rate of deposition of metal on a substrate. Accelerators, which are also known as brighteners, are typically sulfur-containing organic molecules that can act to effect the deposition rate of metal on one or more particular portions of a substrate, and can act to counter the decrease in rate of metal deposition caused by a suppressor. Levelers are generally organic molecules in a metal (e.g., copper metal) plating mixture that can displace an adsorbed accelerator component on the surface of a substrate, and typically work outside the features of a semiconductor substrate to help limit overburden growth.

In some embodiments, restoration of the polarization measure of a metallic plating mixture to a desired level can be achieved by addition of one or more organic components of the mixture. It can be advantageous, in some embodiments, to utilize an organic additive system in which only one component is added to decrease the deviation between the measured current value and the calibration value. For example, a concentrated solution of the organic additive of interest can be added to a working metallic plating mixture. The Bottom Up Index can be monitored to be maintained above a designated threshold. In other embodiments, the deviation is decreased by addition of more than one organic component, e.g., by use of a bleed/feed ratio of fresh metallic plating mixture into the existing metallic plating bath. Alternatively, other mixtures can comprise some other subset of the components of the metallic plating mixture (e.g., use of accelerator and suppressor in concentrated form). Any number of these techniques, and others, can be used to maintain a polarization measure.

More organic components in a metallic plating mixture can also be controlled simultaneously using other techniques in conjunction with the methods disclosed in the present application. For instance, CVS can be used to control the concentration of one organic additive (e.g., accelerator), while the deviation between the current value and the calibration value (e.g., Bottom Up Index) can be used to correct the concentration of another organic additive (e.g., suppressor) by adding the organic additive until the deviation is sufficiently small. Accordingly, some embodiments of the present invention may be especially suited for metallic plating mixtures that utilize two or fewer organic components. As well, other embodiments may utilize more than two organic components if additional technique(s) are capable of controlling additional organic components (e.g., CVS may be used to control two separate organic components, while correcting the deviation between the current value and the calibration value may be used to control a third organic component). Further embodiments can utilize one or more of these techniques simultaneously.

EXAMPLES

The following examples are provided to illustrate some embodiments of the invention. The example is not intended to limit the scope of any particular embodiment(s) utilized.

Experiment 1: Bottom Up Index and Copper Metal Plating Measurements

A copper metal plating mixture was prepared and subjected to varying amounts of charge to simulate bath aging. The copper metal plating mixture utilized in the experiment was a sulfuric-acid aqueous bath including dissolved copper, chloride ions, bis(sodiumsulfopropyl) disulfide as an accelerator, and an alkylene-oxide block copolymer as a suppressor. The initial concentration of the mixture's components is provided Table 1.

TABLE 1

| Initial Concentration of the Copper Metal Plating Mixture | |
|---|---|
| copper (g/L) | 60 |
| sulfuric acid (g/L) | 60 |
| chloride (ppm) | 50 |
| accelerator (mL/L) | 12.5 |
| suppressor (mL/L) | 15 |

The mixture was subjected to increasing amounts of total charge to simulate the aging of the mixture during electroplating. Seven different measurements were taken at various intermittent times during the charging experiment. While the mixture was subjected to such charging, a CVS method was utilized, as implemented on a Q-10® plating bath analyzer (ECI Technology, Inc., Totowa, N.J.) to attempt to maintain the concentrations of the accelerator and suppressor. The CVS method attempted to adjust the accelerator and suppressor concentrations for each Intermittent Measurement to a given set point equal as indicated in Table 2.

TABLE 2

Copper Metal Plating Mixture Concentration Set Points by CVS

| Intermittent Measurement Point | Accelerator Set Point by CVS (mL/L) | Suppressor Set Point by CVS (mL/L) |
|---|---|---|
| A | 12.5 | 15 |
| B | 12.5 | 15 |
| C | 12.5 | 15 |
| D | 12.5 | 15 |
| E | 12.5 | 15 |
| F | 12.5 | 15 |
| G | 12.5 | 23 |

At each intermittent measurement point, a current value, embodied as the Bottom Up Index, was measured and calculated by programming the Q-10® plating bath analyzer. In particular, by viewing the expanded graph comparing the linear sweep voltammetry of a fresh bath and a aged bath, shown in FIG. 1B, it was determined that measuring a current value at a fixed voltage of −0.65 volts, relative to a saturated calomel reference electrode, would provide a good measure of the difference between an aged bath and a fresh bath during copper metal plating on a cathode. A rotating disk electrode was utilized as the working electrode, rotating at a rate of 2500 RPMs.

The procedure for implementing the measurement of current values began by equilibrating each mixture at a temperature of about 22° C. Each mixture was then subjected to a fixed voltage of −0.625 volts relative to the saturated calomel reference electrode for 60 seconds to condition the electrode surfaces. Next, the applied voltage was step changed to −0.65 volts relative to the reference electrode for 120 seconds. The QL-10® plating bath analyzer was programmed to calculate the total charge collected during the 120 second period by the cathodic surface being plated. Those values were utilized to calculate the respective Bottom Up Indexes, which were subsequently plotted in FIG. 2. Measurement A corresponded to a fresh bath, before any charging of the mixture. Measurements D and E corresponded to the same charging condition but in Measurement E the mixture was allowed to sit for a period of time without charging.

Figure 2:
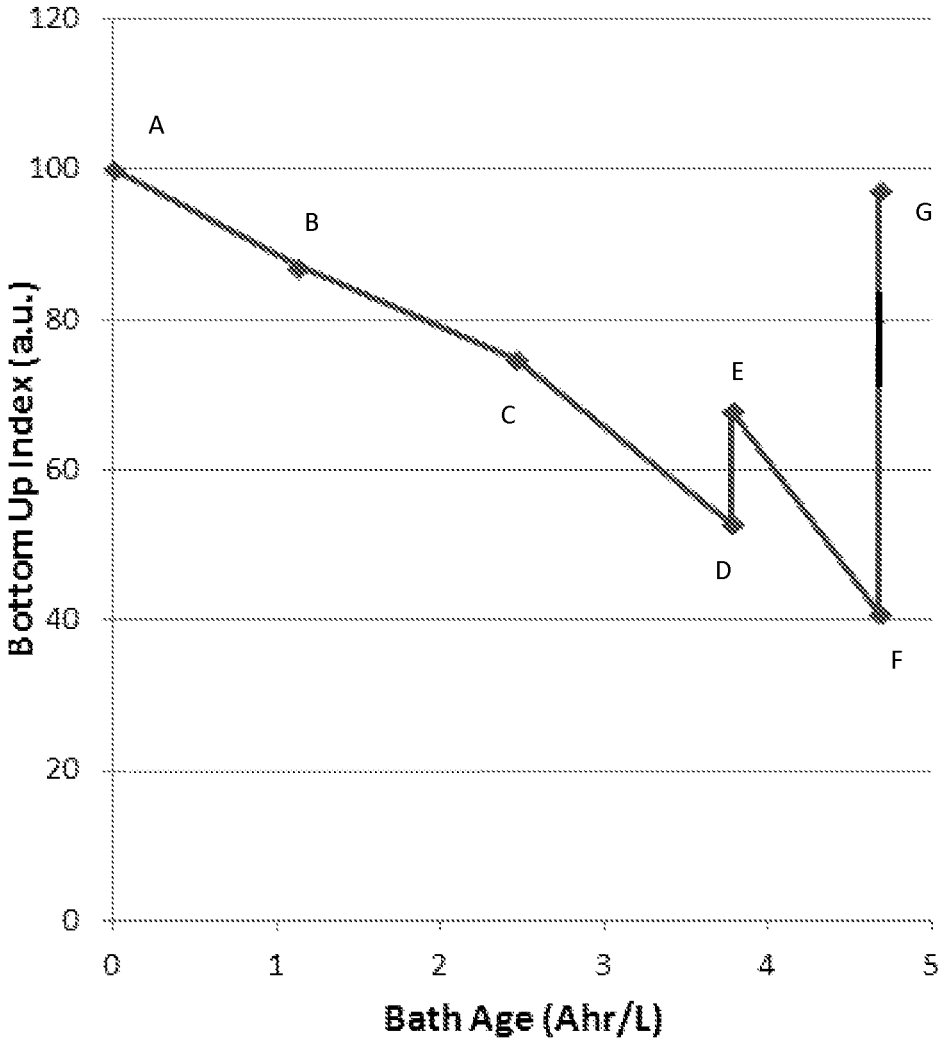
FIG. 2 depicts a graph of calculated Bottom Up Indices as a function Bath Age, in amperes hours per liter, for seven intermittent measurements labeled A through G related to the charging of a copper metal plating mixture consistent with embodiments of the present application.
Figure 3A:
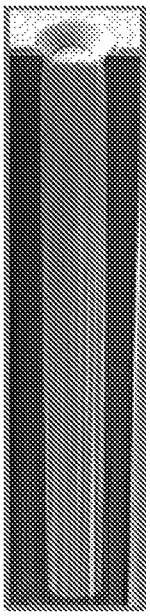
FIGS. 3A-3G depict cross sectional scanning electron micrographs of plated through-silicon-vias filled by electroplating using copper metal plating mixtures designated A-G, respectively, consistent with the Bottom Up Indices shown in FIG. 2, in accord with embodiments of the present application.
Figure 3B:
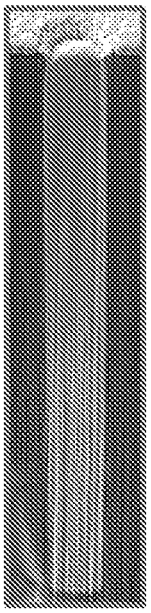
Figure 3C:
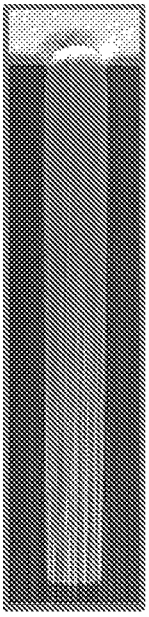
Figure 3D:
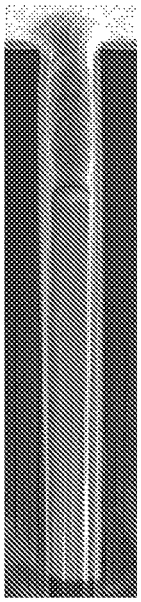
Figure 3E:
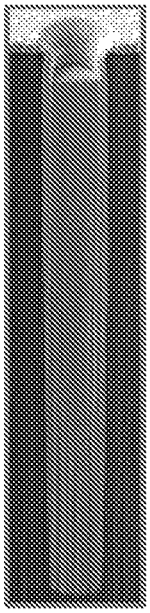
Figure 3F:
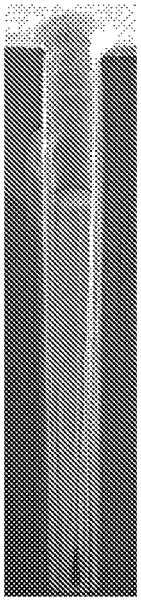
Figure 3G:
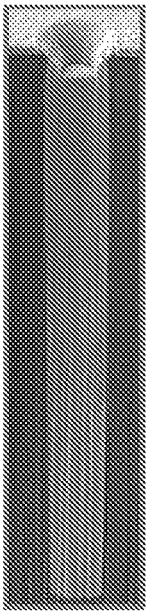

As documented by FIG. 2, Measurements A-F exhibited varying Bottom Up Indices, though corresponding CVS analysis of each Measurement indicated that the amounts of accelerator and suppressor were being maintained at fixed values. Accordingly, the mixture's state in each of Measurements A-F corresponds to a different polarization value.

Changes in the ability of each mixture's copper metal filling performance were ascertained by conducting copper metal plating experiments on samples of the mixture at each of the Intermittent Measurement Points. 250 mL samples of the mixture at each Intermittent Measurement Point were extracted and used to perform through-silicon-via ("TSV") copper metal plating. For each sample, a coupon area of about 2.4 $cm^2$ having vias of size 10 microns×100 microns (IMEC, Leuven, Belgium) was copper plated with the sample in a modified Hull cell with membrane protection of the anode with paddle agitation at about 150 cycles/minute. The coupons were pretreated in deionized water and exposed to ultrasound for 5 minutes before plating commenced. A WaveNow potentiostat/galvanostat (Pine Research Instrumentation, Grove City, Pa.), along with AfterMath software, was used to apply a current density of 1.00 $mA/cm^2$ for a period of 60 minutes. After plating, the coupons were analyzed using scanning electron microscopy ("SEM") with cross sections of vias being imaged to indicate plating performance FIGS. 3A, 3B, 3C, 3D, 3E, 3F, and 3G show the copper plating performance of the TSV fill for each of Intermittent Measure Point samples A, B, C, D, E, F, and G, respectively. It can be seen from the SEM images of FIGS. 3A-3G, and the corresponding data for Bottom Up Index in FIG. 2, that when the Bottom Up Index falls below a critical value of a little over 60, a large change in TSV fill performance is observed, though CVS analysis would indicate that TSV performance should be unchanged since mixture concentrations were within the CVS analysis control. Furthermore, by elevating the CVS control concentration of the suppressor component from 15 mL/L to 23 mL/L, corresponding to Intermittent Measurement Point G, the Bottom Up Index can be recovered to a higher value and corresponding TSV copper fill performance can be maintained or recovered. Accordingly, it can be deduced that the CVS analysis technique can be used to successfully control the accelerator concentration while the Bottom Up Index can be used to control the suppressor concentration to maintain consistent copper fill performance.

Experiment 2: Time Variance of Current During Potentiostatic Measurements

Seven different copper metal plating mixtures were freshly formulated. The mixtures varied in copper concentrations, sulfuric acid concentrations, accelerator concentrations, suppressor concentrations, and suppressor molecule type. Using the QL-10® plating bath analyzer, each formulation was subjected to a fixed voltage of −0.625 volts relative to the saturated calomel reference electrode for 60 seconds to condition the electrode surfaces. Next, the applied voltage was step changed to −0.65 volts relative to the reference electrode for 120 seconds. During the 120 second period, the current was measured.

Figure 4:
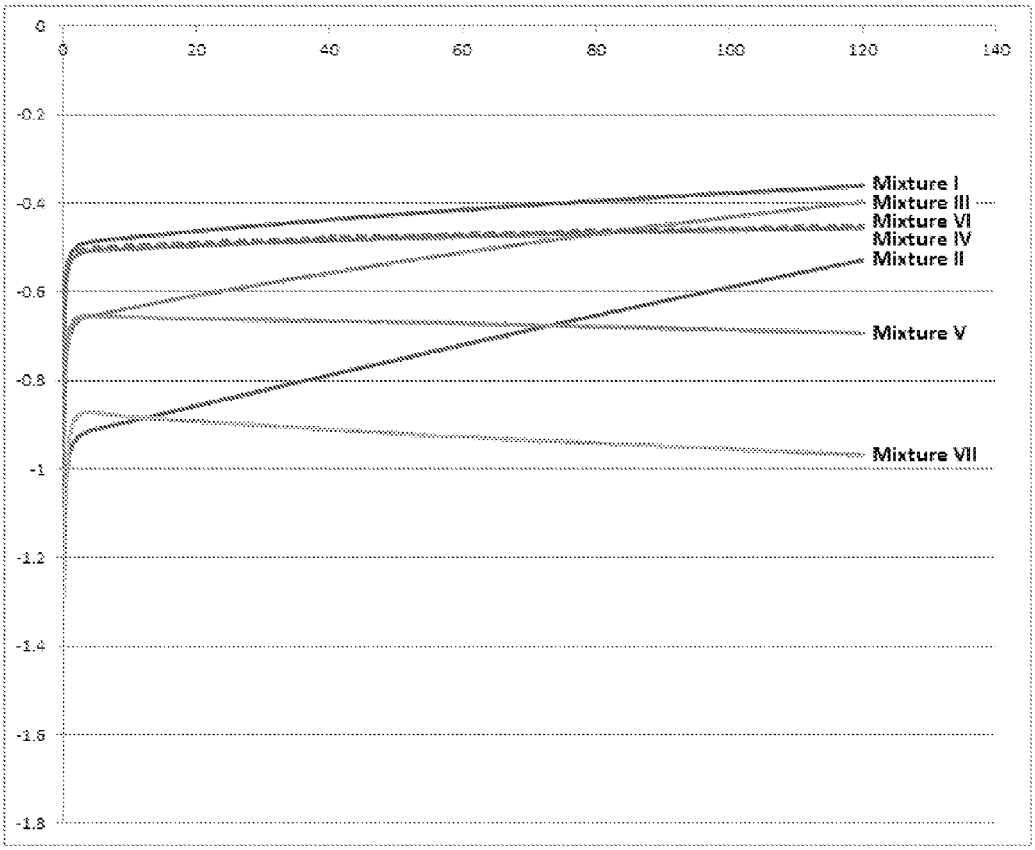
FIG. 4 depicts graphs of measured current in milliamperes over a measurement period of 120 seconds when each of seven different copper metal plating mixtures, I-VII, was exposed to an applied voltage of −0.65 volts relative to a saturated calomel reference electrode consistent with embodiments of the present application.

The measured current for each formulation was plotted against time as shown in FIG. 4. The plots all show that the current varied by more than 5% over the measurement time, and that the plots showed varying slopes and trends. Accordingly, it is clear that the current varies as a function of time over the measurement period.

EQUIVALENTS

While the present invention has been described in terms of specific methods, structures, devices, and formulations it is understood that variations and modifications will occur to those skilled in the art upon consideration of the present invention. As well, the features illustrated or described in connection with one embodiment can be combined with the features of other embodiments. Such modifications and variations are intended to be included within the scope of the present invention. Those skilled in the art will appreciate, or be able to ascertain using no more than routine experimentation, further features and advantages of the invention based on the above-described embodiments. Accordingly, the invention is not to be limited by what has been particularly shown and described, except as indicated by the appended claims.

All publications and references are herein expressly incorporated by reference in their entirety. The terms "a" and "an" can be used interchangeably, and are equivalent to the phrase "one or more" as utilized in the present application. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

What is claimed is:

1. A method for controlling a concentration of an organic additive component in a metallic plating mixture, comprising:

performing electro-metallic plating on a semiconductor substrate using the metallic plating mixture;

applying a fixed voltage between a test cathode and a test anode in at least a portion of the metallic plating mixture to cause metal plating on the test cathode;

measuring at least one current value corresponding with the fixed voltage over a period of time, the at least one current value varying over at least a portion of the period of time;

comparing the at least one current value with a calibration value; and adding a quantity of the organic additive component into the metallic plating mixture based upon a deviation between the at least one current value and the calibration value to thereby adjust the concentration of the organic additive component in the metallic plating mixture.

2. The method of claim 1, wherein the calibration value comprises a calibration current value measure in a fresh metallic plating mixture subjected to the fixed voltage.

3. The method of claim 1 further comprising:

forming a calibration curve comprising a plurality of calibration measurements each corresponding to a particular metallic plating mixture exhibiting a particular polarization measure value, wherein the comparing step comprises comparing the at least one current value with a value from the calibration curve.

4. The method of claim 1, wherein the metallic plating mixture comprises a copper metal plating mixture.

5. The method of claim 1, wherein the at least one organic additive component is a suppressor.

6. The method of claim 1, wherein the metallic plating mixture comprises a plurality of organic additive components.

7. The method of claim 6 further comprising:

performing cyclic voltammetric stripping to control a concentration of at least one additional organic additive component in the metallic plating mixture.

8. The method of claim 6, wherein the method is at least part of a scheme that controls no more than two organic additive component concentrations in the metallic plating bath.

9. The method of claim 1, wherein the applying step and measuring step are performed in a first container having the portion of the metallic plating mixture, the first container being separate from a second container where electro-metallic plating is being performed.

10. The method of claim 1, wherein the test anode and the test cathode are configured to substantially not affect electro-metallic plating on a cathodic surface of the semiconductor substrate.

11. The method of claim 1, wherein the at least one current value is characterized as a current that is integrated over the period of time.

12. A method for performing plating bath metrology, comprising:

performing electro-metallic plating on a semiconductor substrate using a metallic plating mixture;

applying a fixed voltage between a test cathode and a test anode in a portion of the metallic plating mixture to cause metal plating on the test cathode;

measuring at least one current value associated with the fixed voltage;

comparing the at least one current value with a calibration value;

correlating a deviation between the at least one current value and the calibration value with a change in polarization measure of the metallic plating mixture related to a change in a state of the metallic plating mixture; and restoring the polarization measure of the metallic plating mixture to a desired level based on the deviation.

13. The method of claim 12, wherein the measuring step comprises measuring the at least one current value over a designated period of time.

14. The method of claim 13, wherein the at least one current value varies over the designated period of time.

15. The method of claim 12 further comprising:

forming a calibration curve comprising at least two calibration measurements each corresponding to a particular metallic plating mixture exhibiting a particular polarization measure, wherein the comparing step comprises comparing the at least one current value with a value from the calibration curve.

16. The method of claim 15, wherein each particular polarization measure comprises a concentration of at least one component in the metallic plating mixture.

17. The method of claim 15, wherein each particular polarization measure comprises a measure of electro-metallic plating performance.

18. The method of claim 12, wherein the calibration value comprises a calibration current value measure in a test mixture subjected to the fixed voltage.

19. The method of claim 12, wherein the change in polarization measure of the metallic plating mixture corresponds with a change in electro-metallic plating performance.

20. The method of claim 12, wherein the change in polarization measure of the metallic plating mixture corresponds with a deterioration of at least one component in the metallic plating mixture.

21. The method of claim 20 further comprising:

adding a quantity of the at least one component into the metallic plating mixture after the correlating step to decrease the deviation between the at least one current value and the calibration value.

22. The method of claim 20 further comprising:

adding a quantity of the at least one component into the metallic plating mixture based on the deviation between the at least one current value and the calibration value.

23. The method of claim 12, wherein the metallic plating mixture comprises a copper metal plating mixture.

24. The method of claim 12, wherein the metallic plating mixture comprises a plurality of organic additive components.

25. The method of claim 24 further comprising:

controlling a concentration of at least one organic additive component using the deviation between the at least one current value and the calibration value.

26. The method of claim 25, wherein the at least one organic additive component is a suppressor.

27. The method of claim 25 further comprising:

performing cyclic voltammetric stripping to control a concentration of at least one additional organic additive component in the metallic plating mixture.

28. The method of claim 25, wherein the method is at least part of a scheme that controls no more than two organic additive component concentrations in the metallic plating bath.

29. The method of claim 12, wherein the applying step and measuring step are performed in a first container having the portion of the metallic plating mixture, the first container being separate from a second container where electro-metallic plating is being performed.

30. The method of claim 12, wherein the test anode and the test cathode are configured to substantially not affect electro-metallic plating on a cathodic surface of the semiconductor substrate.

31. The method of claim 12, wherein the at least one current value is characterized as an integrated current value over a period of time.

32. The method of claim 12, wherein the step of measuring the at least one current value comprises measuring a plurality of current values associated with the fixed voltage.

* * * * *